US006367667B1

(12) United States Patent
Ipsen

(10) Patent No.: US 6,367,667 B1
(45) Date of Patent: Apr. 9, 2002

(54) COUPLING FOR A CONTAINER VALVE

(75) Inventor: Bernt Ipsen, Morud (DK)

(73) Assignee: Micro-Matic A/S, Odense (DK)

( * ) Notice: Subject to any disclaimer, the term of this patent is extended or adjusted under 35 U.S.C. 154(b) by 0 days.

(21) Appl. No.: 09/508,752

(22) PCT Filed: Sep. 17, 1998

(86) PCT No.: PCT/DK98/00403

§ 371 Date: Jun. 9, 2000

§ 102(e) Date: Jun. 9, 2000

(87) PCT Pub. No.: WO99/15457

PCT Pub. Date: Apr. 1, 1999

(30) Foreign Application Priority Data

Sep. 22, 1997 (DK) ..... 1088/97

(51) Int. Cl.[7] ..... B65D 83/00

(52) U.S. Cl. ..... 222/400.7; 222/399; 222/509; 137/212; 137/322

(58) Field of Search ..... 222/400.7, 400.8, 222/399, 509; 137/212, 322

(56) References Cited

U.S. PATENT DOCUMENTS 4,125,209 A * 11/1978 Bailey ..... 222/400.7
4,159,102 A * 6/1979 Fallon et al. ..... 251/149.6
4,291,821 A * 9/1981 Nezworski ..... 222/153
4,305,421 A * 12/1981 Fallon ..... 137/322
4,436,228 A * 3/1984 Frey ..... 222/400.7
4,450,853 A * 5/1984 Dessenoix et al. ..... 137/212
4,538,746 A * 9/1985 Hines ..... 222/153
4,665,940 A * 5/1987 Jacobson ..... 137/212
4,736,926 A * 4/1988 Fallon et al. ..... 251/149.9
4,834,266 A * 5/1989 Brewer et al. ..... 222/147
5,090,599 A * 2/1992 Stenger ..... 222/400.7
5,535,923 A * 7/1996 Fujioka ..... 222/148
5,617,977 A * 4/1997 Augustinus ..... 222/400.7
6,003,542 A * 12/1999 Pizzacalla et al. ..... 137/397

FOREIGN PATENT DOCUMENTS

GB 1239908 * 7/1971 ..... F16L/37/26
GB 2176466 A * 12/1986 ..... B67D/1/12

* cited by examiner

*Primary Examiner*—Kevin Shaver
*Assistant Examiner*—Frederick C Nicolas
(74) *Attorney, Agent, or Firm*—McCormick, Paulding & Huber LLP

(57) ABSTRACT

A coupling serving for connecting a double valve on a pressure container with a content of pressure gas, such as $CO_2$, and a liquid, such as beer, to a pressure-gas source and a tap for drawing the liquid respectively. The valve comprises a blockable gas and liquid passage respectively, and the coupling comprises a housing for coaxial mounting on an upper flange on the valve, a slide which is placed in the housing and which can be displaced by means of a hand grip between an upper position where the valve is closed and a lower position where the valve is open; an elastomeric sleeve secured onto the slide and forming sealing between the slide and the valve flange in the mounted position of the coupling; a mainly tubular plunger secured in the slide; and a gas chamber formed between the plunger, the sleeve, and an inner wall in the slide. The plunger serves to open the valve in the lower position of the slide so that connection is made between the liquid passage of the valve and a liquid outlet on the slide via the chamber of the plunger, and connection is made between the gas passage of the valve and a gas outlet on the slide via the gas chamber. On the plunger is a seat for a sealing ring made in one piece with the sleeve which furthermore is arranged in such a way that the sealing ring is lifted free of the seat in the mounted condition of the coupling, and abuts against the seat in the dismantled condition of the coupling. This structure is simple and inexpensive and provides a better security against gas outflow when the coupling is dismantled than known so far.

20 Claims, 3 Drawing Sheets

COUPLING FOR A CONTAINER VALVE

BACKGROUND ART

The invention relates to a coupling for connecting a double valve defining an axis and placed on a pressure container containing pressure gas, such as $CO_2$, and liquid, such as beer, to a pressure-gas source and a tap for drawing the liquid, respectively, whereby the valve comprises a blockable gas and liquid passage, respectively, and the coupling comprises a housing for coaxial mounting on an upper flange on the valve; a slide which is placed in the housing and which can be displaced by means of a hand grip between an upper position where the valve is closed and a lower position where the valve is open, an elastomeric sleeve secured onto the slide and forming sealing between the slide and the valve flange in the mounted position of the coupling, a tubular plunger secured in the slide; and a gas chamber formed between the plunger, the sleeve, and an inner wall in the slide; whereby the plunger serves to open the valve in the lower position of the slide so that a connection is made between the liquid passage of the valve and a liquid outlet on the slide via the chamber of the plunger, and a connection is made between the gas passage of the valve and a gas outlet on the slide via the gas chamber.

GB Patent No. 1 239 908 discloses such a coupling. In this case, a metal pipe is placed in the gas chamber of the coupling; the pipe is secured to the bottom of the elastomeric sleeve of the coupling by means of an outwardly directed flange. The metal pipe extends upwards along the inner side of the sleeve and has an inwardly directed collar abutting against an elastomeric ring in an annular groove in the plunger in the dismantled position of the coupling. During mounting, the sleeve is compressed whereby the inwardly directed collar of the metal pipe is lifted from its abutment on the elastomeric ring so that there is opened for inlet of gas to the gas passage of the valve and thereby to the pressure container. The object of this structure is to eliminate the possibility of gas flowing out of a dismantled coupling.

However, this structure is complicated and expensive as it is made up of several components and in addition to this the sealing effect is unsafe in the dismantled position of the coupling. The latter is especially due to the fact that the elastomeric ring is inserted loosely in a groove in the plunger, and leaks can be formed between the plunger and the projecting elastomeric ring when the metal pipe affects this ring with a moment that—seen in cross-section—is likely to distort the elastomeric ring. The moment is caused by the quite considerable, in proportion to the structure, axial forces that are generated due to the building up of gas pressure in the gas chamber and the decompression of the sleeve, and that are transmitted to the elastomeric ring via the metal pipe.

The structure furthermore means that the metal pipe must extend upwardly in the gas chamber and the already narrow passage area is therefore further reduced. In order to allow the gas to pass, the metal pipe must furthermore be so fragile that it will contribute to making the sealing between the elastomeric ring and the inwardly directed collar of the metal pipe unsafe in a dismantled coupling.

The object of the invention is to show a coupling of the kind mentioned in the opening paragraph that, with a simple and inexpensive structure, provides a better guarantee against gas outflow when the coupling is dismantled than known so far.

SUMMARY OF THE INVENTION

The novel and unique features according to the invention, whereby this is achieved, is the fact that a seat for a sealing ring is made in one piece with the plunger, the sealing ring is made in one piece with the sleeve which is furthermore arranged in such a way that the sealing ring is lifted free of the seat in the mounted condition of the coupling, and abuts against the seat in the dismantled condition of the coupling. This structure does not require any extra components and there are no loose parts. It is therefore inexpensive to manufacture and forms a safe and effective sealing for the pressure gas when the coupling is dismantled.

In an especially simple embodiment, an outwardly directed collar can be made on the lower pressure foot on the plunger for activating the valve; the top side of the collar forms a seat for the sealing ring.

Above the seat, the plunger can furthermore have a first, preferably cylindrical section and in continuation of this, a second, preferably cylindrical section with a smaller diameter than the first section. In dismantled condition of the coupling, the sealing ring can then advantageously enclose the first cylindrical section in contact with or at a short distance from this when the coupling is dismantled and the sealing ring abuts against the seat on the plunger. The result of this is that the first cylindrical section in co-operation with the sealing ring will contribute to seal against outflowing gas when the coupling is dismantled.

The sleeve can furthermore be arranged in such a way that it is deformed when the coupling is mounted and thereby its sealing ring is axially displaced past the first cylindrical section on the plunger whereby the free passage area for the gas is increased.

By forming the elastomeric sleeve with a cross section having a V-shape with radially, outwardly directed point, the sleeve obtains an advantageously flat compressibility characteristic allowing for a considerable, axial compression of the sleeve without at the same time a great increase of the forces used to compress the sleeve.

An effective and safe sealing between the slide and the valve flange is obtained if the sleeve furthermore has a downwards converging sealing lip under the sealing ring.

The sealing ring which is made in one piece with the elastomeric sleeve can advantageously be stabilised and stiffened by an inserted reinforcing ring of e.g. stainless steel.

When the coupling is dismantled, liquid in the plunger chamber can run or drip out and pollute the surroundings. In order to avoid this disadvantage, the pressure foot can have an inwardly directed collar forming a seat for a non-return flap placed in the tubular plunger together with a superjacent compression spring to keep the non-return flap abutting against said seat. The non-return flap functions as a non-return valve during operation but is closed for reflux when the coupling is dismantled.

Conventionally, the liquid outlet is lead axially out through the housing, but in an advantageous embodiment according to the invention, the liquid outlet together with the gas inlet is lead sideways out through an axially extending mortise in the side wall of the housing. Thereby, an expedient piping to the gas source and the barrel tap with an attractive appearance is obtained. At the same time, the chamber in the housing above the slide is left free for the hand grip.

The hand grip can furthermore be pivotally mounted about a swing axis in the housing and be made to run with pressure pins across curved pressure surfaces on each side of the slide when the hand grip is pressed down whereby the pressure surfaces have such a form that the pins at first drive the plunger down to mounted position for finally locking the hand grip.

The pressure surfaces can furthermore be formed as the lower side of curved tracks placed on each side of the slide serving for guides for the pressure pins. In order to be able to lead the pressure pins down to engage with these guide tracks, axial introduction tracks can be made that extend from the guide tracks to the top side of the slide.

A conventional coupling has a centrally placed compression spring for holding the slide in its upper position. The coupling according to the invention can instead have at least one extension spring acting between the housing and the slide, the extension spring is displaced radially relative to the axis of the housing so that the handle grip can swing across this axis and thereby obtains an expedient placing of the angle over which the hand grip can swing.

The invention will be explained in greater detail below, describing only an example of an embodiment with reference to the drawing, in which

BRIEF DESCRIPTION OF THE DRAWINGS

In FIG. 1 is seen a coupling 1 mounted on a double valve 2 tightly fastened in a connection piece 3 on a pressure container 4 for distribution of a liquid, such as beer or soft drinks, under pressure of a gas, which typically can be $CO_2$. The container and the double valve are only shown in fragments.

At the top, the valve has a flange 5 and the coupling has gripping jaws 6 for gripping under the flange 5 for detachably fastening the coupling on the valve. This operation takes place by pushing the coupling crosswise across the flange of the valve.

DETAILED DESCRIPTION OF AN EMBODIMENT

Figure 1:
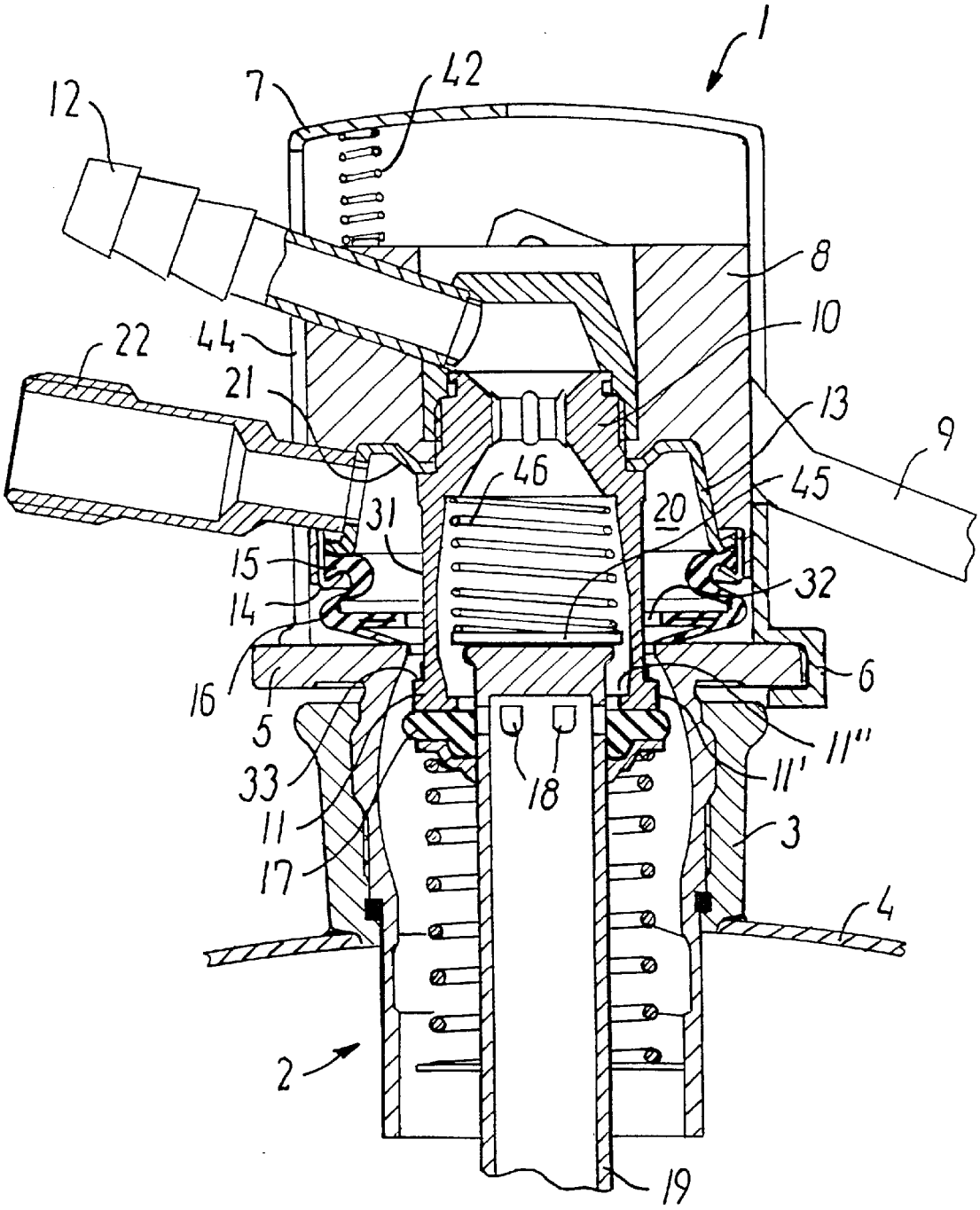
FIG. 1 is an axial sectional view through a coupling according to the invention mounted on a double valve on a pressure container.

The coupling comprises a housing 7 with a slide 8 that can be lead from an upper position (FIG. 2 and 4) to the lower position shown in FIG. 1 by means of a hand grip 9.

A mainly tubular plunger 10 with a pressure foot 11 is placed in the slide 8 which for example can be made of plastic. At the top, the plunger is connected to a liquid outlet 12. The plunger 10 can for example be made of metal.

A cup 13 is furthermore fastened in the slide. The cup has a relatively thin thickness of plate and is expediently made of stainless steel.

The edge of the cup is beaded around a collar 15 on an elastomeric sleeve 16 serving for forming a sealing the slide 8 and the valve 2 in the situation shown in FIG. 1 where the coupling 1 is fastened to the flange 5 of the valve 2 and the slide 8 is pressed down to its lower position by actuating the hand grip 9.

The valve is open in this lower position as the plunger 10 with its pressure foot 11 has pressed a valve ring 17 axially downwards so that openings 18 in a riser pipe 19 are uncovered. The liquid is then pressed by the pressure gas up through the riser pipe 19 and via the openings 18 in the riser pipe further through the tubular plunger 10 to the liquid outlet 12 which via a hose or a pipe (not shown) is connected to a tap (not shown) for drawing the liquid.

A gas chamber 20 is delimited by the plunger 10, the sleeve 16, and an inner wall 21 in the cup 13. A gas inlet 22, which via a hose or a pipe (not shown) is connected to a pressure-gas source, e.g. a gas cylinder (not shown), is lead into the gas chamber 20. The gas can now flow into the container via the gas chamber 20 and a space between the sleeve 16 and the plunger 10.

Figure 2:
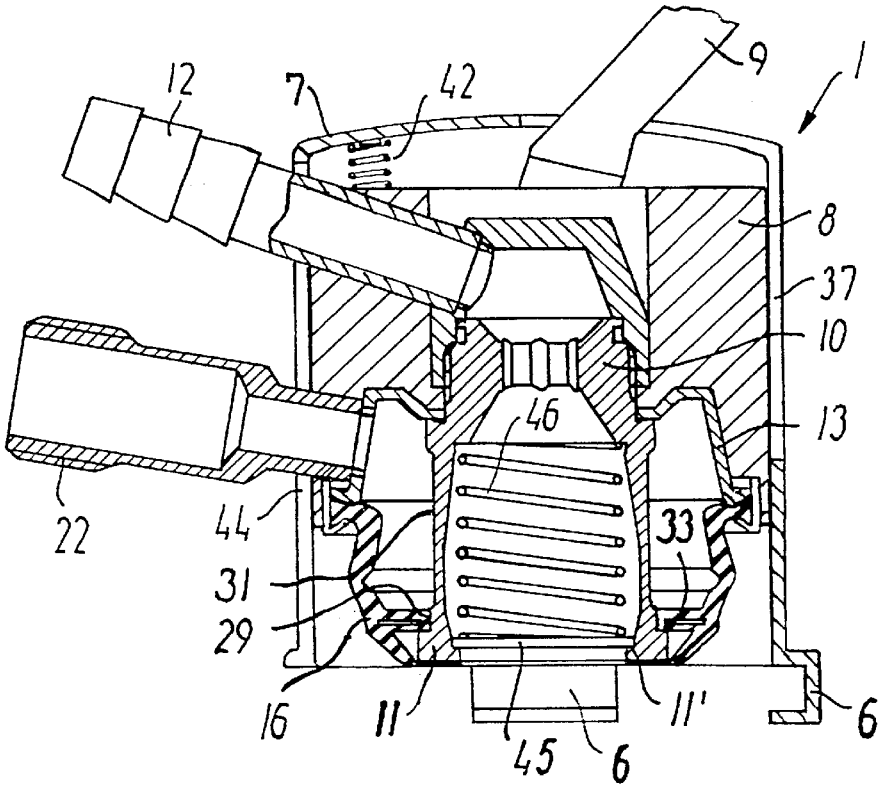
FIG. 2 is an axial sectional view through the coupling in FIG. 1 in dismantled condition.

In the position shown in FIG. 1, the coupling is in its working position. When the coupling 1 is to be dismantled, the slide 8 is lifted with the hand grip 9 after which the coupling can be dismantled. FIG. 2 shows a dismantled coupling which is assumed to be in continuous open connection with the pressure-gas source. However, the sleeve shuts off gas outflow to the surroundings where an accumulation of e.g. $CO_2$ can be harmful or fatal to persons living there.

Figure 3:
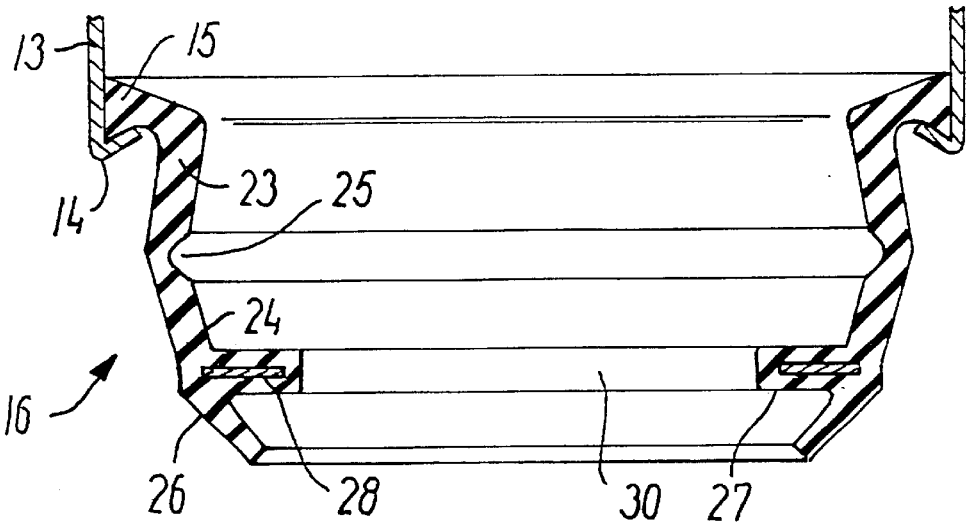
FIG. 3 is on a larger scale an axial sectional view through an elastomeric sleeve for the coupling in FIG. 1 and 2.

The elastomeric sleeve 16 is seen best in FIG. 3 and as mentioned it has a collar 15 around which the edge 14 of the cup 13 is beaded, the cup is only seen in fragments in the figure. The sleeve has a first conical section 23 extending from the collar 15 and a second conical section 24 extending from the first conical section 23. Seen in cross-section, the two sections 23 and 24 together form a V the point of which is facing radially outwards. At the transition between the two sections, an annular groove 25 is made inside so that the sleeve has a reduced wall thickness on this spot.

The second section 24 is carried on into a third section 26 with a somewhat larger conicity than the two other sections. Between the second and the third section there is furthermore a sealing ring 27 integrated with the sleeve with an inserted reinforcing ring 28 of e.g. metal.

Above the pressure foot 11, the plunger 10 has a first cylindrical section 29 with a diameter corresponding to the diameter of the sleeve opening 30.

The axial length of the first cylindrical section 29 is proportioned so that the sealing ring is lead into the area around the second cylindrical section 31 when the sleeve is compressed at mounting, as shown in FIG. 1. Thereby, a space 32 is formed between the plunger 8 and the sealing ring 27, and as mentioned earlier this space allows the gas to pass.

The sleeve is made of an elastomer, such as rubber, and it can be compressed to a highly reduced height without a drastic increase in the compression forces in consequence of its V-shaped cross section which causes the sleeve to function as some kind of bellows with the qualities of a compression spring as its wall during compression is pressed radially outwards with a mutual folding between the two sections 23 and 24 at the thinner wall area in the groove 25. At the same time, the third section 26 functions as a sealing lip 26 ensuring effective sealing between the slide 8 and the valve flange 5 when the coupling 1 is mounted on the valve 2 and this valve is open.

In the dismantled position shown in FIG. 2, the sleeve 16 is however decompressed so that the sealing ring 27 in consequence of the spring effect of the sleeve is made to abut tightly against the upper side 33 of an outwardly directed collar 11'formed on the pressure foot 11 and therefore acts as seat for the sealing ring. The coupling is now shut off to gas outflow.

Figure 4:
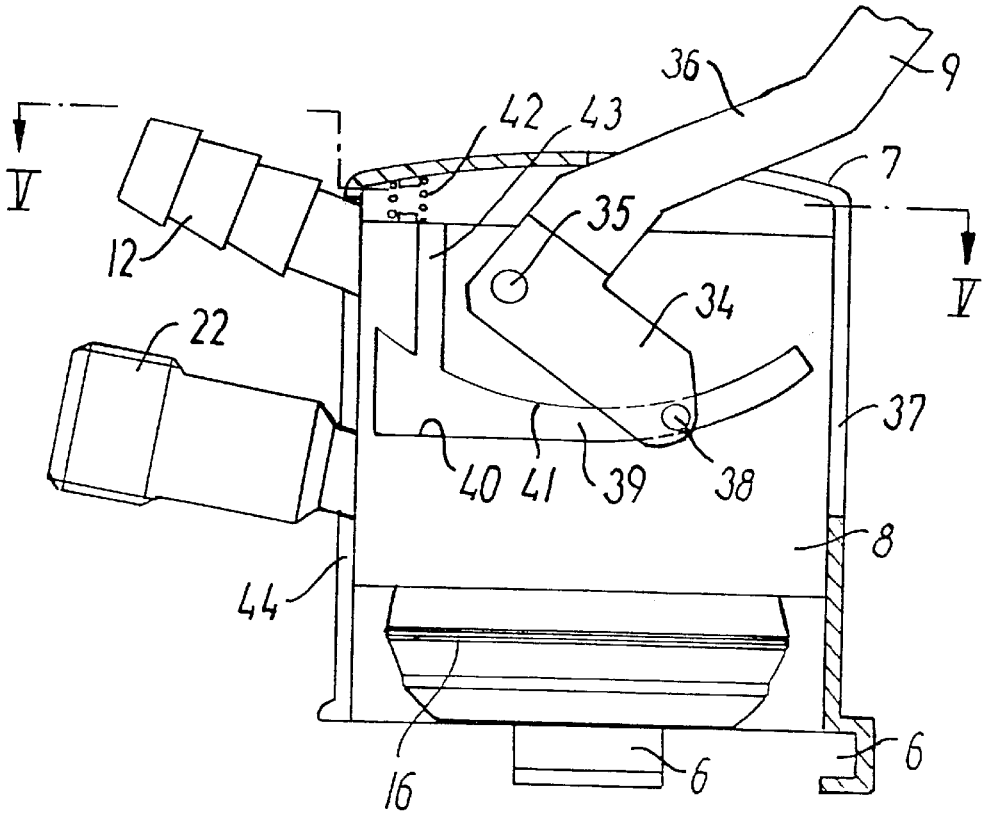
FIG. 4 is a view of the coupling in FIG. 1 and 2 partly in axial section.
Figure 5:
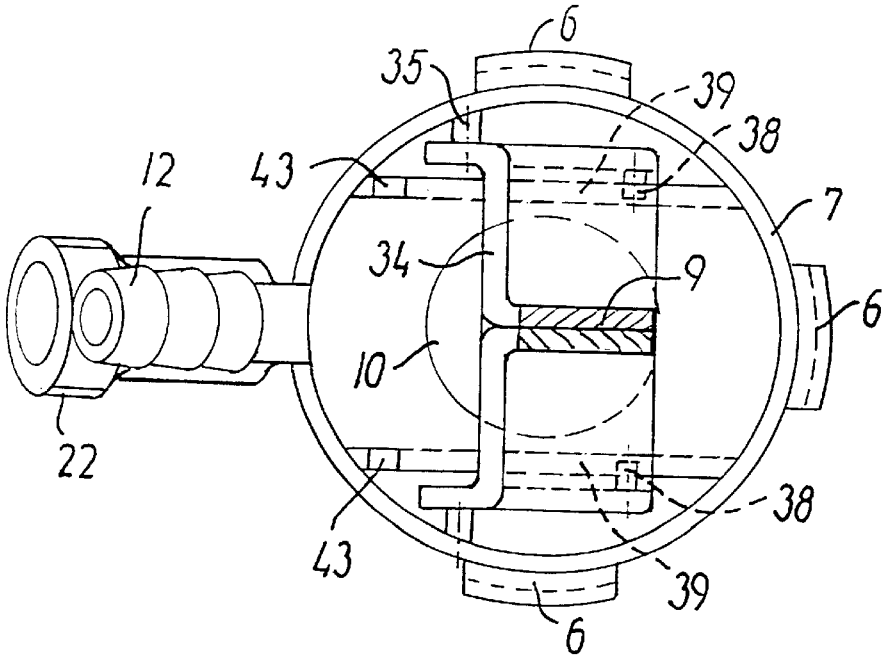
FIG. 5 is a sectional view taken along the line V—V of FIG. 4.

As shown in FIG. 4 and 5, the hand grip 9 is shaped as a fork with two prongs 34 pivotally mounted with bearings 35 on the inside of the housing 7, and an operating lever 36 extending out through a mortise 37 in the housing.

As shown in FIG. 4, the prongs 34 of the fork form an angle with the operating lever. At the end, each prong 34 has an inwardly directed pin 38 extending into the tracks 39 of a curved guide; the tracks are made on each side of the slide 8.

The lower side of each guide track forms a pressure surface 40 on the slide 8. When the hand grip 9 is swung from the position shown in FIG. 2 and 4 to the one shown in FIG. 1, the pins run across this pressure surface 40 so that the slide 8 is pressed down to its lower position where the hand grip finally is locked due to the shape of the pressure surfaces.

When the hand grip 9 is swung from the position shown in FIG. 1 to the one shown in FIG. 2 and 4, the pins 38 run along the upper side 41 of the guide tracks 39 so that the slide 8 is lifted.

Extension springs 42 acting between the slide 8 and the housing 1 and which are displaced relative to the coupling axis also serve for lifting the slide and holding it in the upper position shown in FIG. 2 and 4.

By means of axially extending introduction tracks 43 extending from the guide tracks 39 to the top side of the slide 8, the pins can be pushed into the guide tracks 39 when the hand grip is in its lower swing position.

As shown, both the liquid outlet 12 and the gas inlet 22 are extending sideways out through the housing via an axially extending mortise 44 made in the side wall of the housing and allowing the liquid outlet and the gas inlet to move axially relative to the housing when the slide is lead back and forth between its two positions.

As described above, the sleeve ensures that gas do not flow out of a dismantled coupling. The liquid that still is in the tubular plunger 10 at dismantling and possibly in the connections to the tap will however still be able to run or drip out of the dismantled coupling and pollute the surroundings.

In order to prevent this disadvantage, a non-return valve in the form of a non-return flap is placed in the plunger, the non-return flap is held in abutment against an inwardly directed collar 11" on the pressure foot 11 by a compression spring 46 when the coupling is dismantled while it breaks loose of this seat in the mounted and activated position of the coupling and allows liquid to pass.

What is claimed is:

1. A coupling for connecting a pressure container to a pressure-gas source the pressure container having a double valve with a flange and containing a pressure gas and a liquid, the coupling comprising:

a housing for coaxial mounting of an upper flange on the double valve;

a slide within the housing that is displaceable between an upper position where the valve is closed and a lower position where the valve is open;

a tubular elastomeric sleeve having one end secured onto the slide and an opposing sealing lip end that forms a seal against the valve flange when the coupling is mounted on the container, said elastomeric sleeve further including an inwardly directed sealing ring adjacent to the sealing lip end;

a tubular plunger secured in the slide; and a gas chamber defined by the elastomeric sleeve, the plunger and an inner wall of the slide.

2. A coupling according to claim 1 wherein the sealing ring is made in one piece with the elastomeric sleeve.

3. A coupling according to claim 1, wherein the plunger includes a seat, a first cylindrical section above the seat and defining a first diameter and a second cylindrical section defining a diameter smaller than the first diameter, and wherein the sealing ring proximally encloses the first cylindrical section and abuts against a seat on the plunger.

4. A coupling according to claim 1, 2, or 3, wherein the elastomeric sleeve is deformed and its sealing ring is displaced axially past a first cylindrical section on the plunger when the coupling is mounted.

5. A coupling according to claim 1, wherein the elastomeric sleeve includes a diverging first section and a converging second section extending from the first section and down to the sealing ring.

6. A coupling according to claim 1, wherein the sealing ring comprises a rigid reinforcing ring.

7. A coupling according to claim 1, wherein the plunger includes a pressure foot with an inwardly directed collar forming a seat; the coupling further including a superjacent compression spring that biases a non-return flap within the plunger against said seat.

8. A coupling according to claim 1, further including a liquid outlet and a gas inlet extending through an axial slit in a side wall of the housing.

9. A coupling according to claim 1, wherein a hand grip for moving the slide is pivotally mounted about a swing axis in the housing and includes an operating lever extending through a side wall of the housing, and a pressure arm with two prongs with pressure pins that abut pressure surfaces of the slide when the operating lever is moved downwards, said pressure surfaces including a curved portion to facilitate movement of the slide and a flat portion to facilitate locking of the hand grip.

10. A coupling according to claim 1, further comprising at least one extension spring acting between the housing and the slide and displaced radially about an axis of the housing.

11. A coupling according to claim 5, wherein, the elastomeric sleeve includes a converging third section that forms the sealing lip.

12. A coupling according to claim 9, further including tracks on each side of the slide, said tracks comprising:

lower curved surfaces defining the pressure surfaces; and axial extensions for receiving the pressure pins and for bringing the pressure pins into engagement with the lower curved surfaces.

13. A coupling for mounting on a pressure container having a double value and a flange to connect the container to a gas source and for dispensing the contents of the container, said coupling comprising:

a housing and a hand grip movably mounted thereon, a slide in the housing movable between open and closed double valve positions by said hand grip to open and close the double valve, an elastomeric sleeve on said slide, one end of said elastomeric sleeve defining a lip for sealing engagement with the flange a tubular plunger secured in the slide and defining a gas chamber between said sleeve and said plunger and said slide, said plunger defining an external seat;

said elastomeric sleeve connected at an opposite end to said movable slide, and said sleeve defining an internal sealing ring engageable with said external seat defined by said plunger, said sealing ring including a reinforcing ring of non-elastomeric material molded into said tubular elastomeric sleeve.

14. The coupling according to claim 13 wherein said plunger includes a collar defining a pressure foot, one side of said collar forming a valve seat, adapted for engagement with a valve ring provided on the double valve.

15. The coupling according to claim 14 wherein said collar also defines a seat for said sealing ring of said elastomeric sleeve.

16. The coupling according to claim 15 wherein said elastomeric sleeve is deformable in it's axial direction to accommodate axial motion of said tubular plunger.

17. The coupling according to claim 16 wherein said elastomeric sleeve has both diverging and converging sections between one end and said sealing ring to facilitate the axial deformation of the elastomeric sleeve.

18. The coupling according to claim 17 wherein said elastomeric sleeve further defines a converging section at the opposite end thereof and said double valve including a flange engageable by said elastomeric sleeve other end.

19. A coupling for mounting on a pressure container having a double valve and a flange to connect the container to a gas source and for dispensing the contents of the container, said coupling comprising:

a housing and a hand grip movably mounted thereon, a slide in the housing movable between open and closed double valve positions by said hand grip to open and close the double valve.

an elastomeric sleeve on said slide, one end of said elastomeric sleeve defining a lip for sealing engagement with the flange a tubular plunger secured in the slide and defining a gas chamber between said sleeve and said plunger and said slide, said plunger defining an external seat, said elastomeric sleeve connected at an opposite end to said movable slide, and said sleeve defining an internal sealing ring engageable with said external seat defined by said plunger, and said plunger defining an inwardly formed collar, a spring acting against said collar to provide a restoring force on the double valve biasing the double valve toward its closed position.

20. A coupling for mounting on a pressure container having a double value and a flange to connect the container to a gas source and for dispensing the contents of the container, said coupling comprising:

a housing and a hand grip movably mounted thereon, a slide in the housing movable between open and closed double valve positions by said hand grip to open and close the double valve.

an elastomeric sleeve on said slide, one end of said elastomeric sleeve defining a lip for sealing engagement with the flange a tubular plunger secured in the slide and defining a gas chamber between said sleeve and said plunger and said slide, said plunger defining an external seat, said elastomeric sleeve connected at an opposite end to said movable slide, and said sleeve defining an internal sealing ring engageable with said external seat defined by said plunger, and a spring acting against said plunger to provide a restoring force on the double valve to urge the double valve toward a closed position.

* * * * *